US005558278A

United States Patent [19]

Gallorini

[11] Patent Number: 5,558,278

[45] Date of Patent: Sep. 24, 1996

[54] SHOWER NOZZLE

[75] Inventor: Massimo Gallorini, Arezzo, Italy

[73] Assignee: A.B.G. S.r.l., Arezzo, Italy

[21] Appl. No.: 321,812

[22] Filed: Oct. 3, 1994

[30] Foreign Application Priority Data

Oct. 6, 1993 [IT] Italy ..... AR930027 U

[51] Int. Cl.[6] ..... B05B 1/14

[52] U.S. Cl. ..... 239/553.3; 239/553.5; 239/596; 4/567; 4/615

[58] Field of Search ..... 239/548, 553.3, 239/553.5, 590.3, 590.5, 596, 106, 110, 561; 4/615, 567, 568, 569, 570

[56] References Cited

U.S. PATENT DOCUMENTS

| | | | |
|---|---|---|---|
| 1,195,686 | 8/1916 | Kelly | 239/110 |
| 1,597,477 | 7/1924 | Panhorst | 239/548 |
| 1,633,531 | 6/1927 | Keller | 4/615 |
| 1,724,161 | 8/1929 | Wuesthoff | 239/548 |
| 1,752,633 | 4/1930 | Crane | 4/615 |
| 2,643,104 | 6/1953 | Holden | 239/548 |
| 2,874,001 | 2/1959 | Webb | 239/106 |
| 2,890,835 | 6/1959 | Filliung | 239/548 |
| 4,272,022 | 6/1981 | Evans | 239/553.3 |

FOREIGN PATENT DOCUMENTS

| | | | |
|---|---|---|---|
| 1199271 | 12/1985 | U.S.S.R. | 239/596 |
| 1650264 | 5/1991 | U.S.S.R. | 239/548 |
| 1653845 | 6/1991 | U.S.S.R. | 239/552 |

*Primary Examiner*—Andres Kashnikow
*Assistant Examiner*—Lisa Douglas
*Attorney, Agent, or Firm*—Young & Thompson

[57] ABSTRACT

The invention concerns a shower nozzle (7), equipped with two apertures (12) and (13), one for drainage and one for ventilation, at least the former of which being bigger than the spray perforations (9), which, inside the rose (4), emerge from an inclined surface (8) that counteracts the build-up of lime scale.

5 Claims, 1 Drawing Sheet

SHOWER NOZZLE

FIELD OF THE INVENTION

Description

The invention relates to a shower nozzle, which will divide water coming from a water pipe into many minuscule fine jets of water directed onto the body of the person who places him or herself under the shower.

BACKGROUND OF THE INVENTION

In shower units, the water from the pipe where the mixer and/or closure valve is positioned, is conveyed to a rose at the end of the unit. The rose is often bell-shaped, closed at the bottom by the nozzle where a mass of very small holes are distributed, through which water, in the form of many minute jets, is sprayed like rain on the user.

The nozzle is usually made of plastic and has a cylindrical trunk shape with a hole in the middle via which it is screwed onto the rose or metallic supporting structure.

With another alternative, the edge of the nozzle is rolled over and held together with the rose by a threaded ring. Lastly there are other technical alternatives wherein the nozzle is attached to the rose which feeds it with the water to be sprayed.

Regardless of the type of anchorage and its particular shape, the nozzle is equipped with many minuscule holes which perforate it, in some cases having a cylindrical shape, in others having a shape that is initially a truncated cone and then cylindrical at the extreme that starts inside the rose.

A nozzle structure with spray perforations made in this way facilitates the formation and accumulation of lime scale therein, and therefore the blockage of these perforations so that the unit becomes unusable.

What, in fact, happens with the shower unit is, when the regulator for the water flow housed inside the pipes before the rose is turned off, not all the water comes out. A portion of the water remains in the rose due to depression in the pipe. Due to capillary and surface tension effects, the minuscule spray perforations retain water inside where it slowly evaporates due to the relatively high temperature that the rose reaches during the downflow of water which is normally heated.

Lime scale and solid substances dissolved in the water and incrustations, build up particularly around the fine spray holes until they cause them to clog up.

Following this, it is necessary to disassemble the nozzle and, remove it from the rose, clean it with liquid solvents capable of dissolving the lime scale or with fine needles which, when pushed into the perforations with the intention of freeing them of the lime scale, cause them to be widened and so, over time, the nozzle undergoes damage.

SUMMARY OF THE INVENTION

The aim of the current invention is to create a shower nozzle, designed so that it remains unaffected by lime scale build-up, or at any rate designed in such a way that it is able to facilitate the rapid downflow of water therethrough, by impeding the collection of water inside the rose and the condensation of salts dissolved therein. Such a shower nozzle will therefore prevent the build up of deposits in the nozzle which, over time clog it up, forcing users to make occasional repairs during which the nozzle is cleaned and its holes are "renewed".

The invention which achieves the described results is embodied by a disc-shaped structure, with external shape and means and/or structures that render it suitable to be attached to any shower rose, characterized by two apertures, one for drainage and the other for ventilation, at least the former of which being bigger than the spray perforations, which, inside the rose, emerge from a inclined surface housed therein.

A structure made in this way achieves the aforementioned advantages. Firstly the wider apertures (normally two or three times that of the spray holes) permit the lower hole to rapidly empty the water contained inside the rose, while the other, higher hole permits the internal ventilation of the rose. The prevents the formation of a depression therein which would tend to retain liquid and lead to the formation of fine layers of water which would block up the same spray holes.

Secondly, the very fine spray holes normally begin from a higher level than that of the inclined surface at the internal base of the rose. Hence, they are no longer fed before the water inside the rose has finished draining out from the wider drainage hole positioned at a lower point in the internal surface of the nozzle inside the rose. Lastly, the spray perforations have an internal profile that is preferably a truncated cone, which facilitates the break up of layers of water or liquid film that form there and which, due to surface tension, tend to block the perforations and facilitate lime scale build-up.

The described effects are facilitated by the shape and/or lay-out of the nozzle which has the drainage hole at a level lower than the ventilation hole, so that the latter could have a smaller diameter.

BRIEF DESCRIPTION OF THE DRAWINGS

The nozzle in question and its design can be more easily understood by following the detailed description below and the attached illustrative drawings referring to preferred embodiments of the nozzle, where.

DETAILED DESCRIPTION OF THE INVENTION

Figure 1:
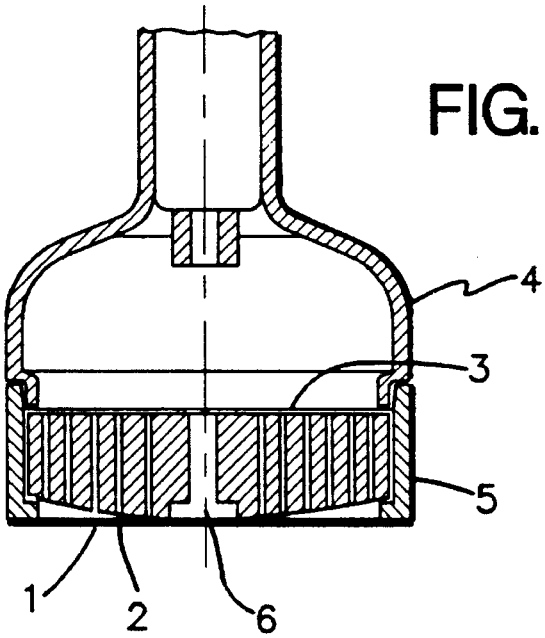
FIG. 1 is the view of a common shower rose, in vertical section equipped with spray nozzle.

It is to be understood that the drawings serve to facilitate the comprehension of the invention without, in any way restricting it as far as its outer shape and means of attachment to the rose are concerned.

In the drawings, the number 1 refers to the traditional nozzle; the number 2 the spray holes therein; 3 is its top surface inside the rose 4; 5 is the threaded ring and 6 is the seat for the anchorage screw of the nozzle 1, assuming there is double anchorage.

The number 7 shows the nozzle that is the subject of the invention with an irregular shape and thickness; 8 is the uneven surface at the top of the nozzle; 9 represents the spray holes or perforations, 10, the protuberances on the surface 8 from the tops 11 of which the holes 9 begin; 12 is the drainage hole or aperture and 13 is the hole for the aspiration of air.

Figure 4:
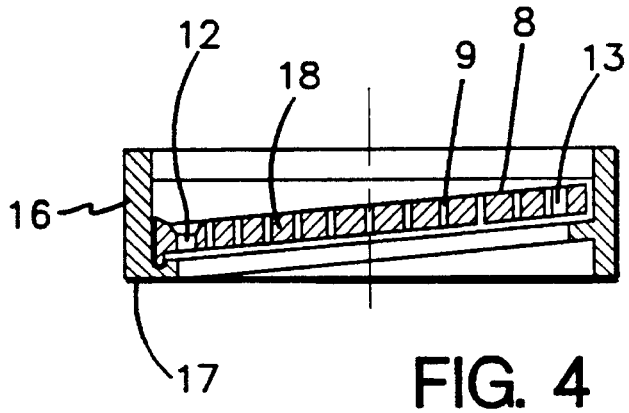
FIG. 4 exemplifies a nozzle with uniform thickness positioned on an oblique plane.
Figure 2:
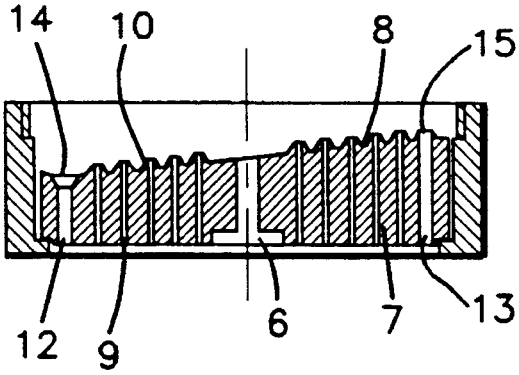
FIG. 2 is the view of a nozzle held in place by a metal ring shown in this solution to have an irregular thickness with the ends of the spray holes housed at the top of tiny truncated cones.

In the solution exemplified in FIG. 4, the number 18 represents the nozzle with a virtually even thickness positioned on the metal ring 16 that holds it at an angle, with 12 the drainage hole and 17 the tooth that holds it in position on the supporting metal ring 16.

The nozzle or spray disc of the shower unit is therefore designed in shape and means of anchorage in such a way that it can be applied to the various embodiments of the roses 4 or the equivalent means with which shower units are finished; it has an uneven upper surface 8 that slants so as to favour the water flow towards the drainage hole 12, if necessary equipped with grooves aimed at facilitating the flow of water towards this hole, the top of which is at the same level as the surface 8 or connected to it via a recess in the shape of an upturned truncated cone designed to facilitate the outflow of all the water inside the rose 4.

This nozzle is equipped with ventilation aperture 13 positioned in the thickest part of the nozzle, or, at any rate with its opening 15 inside the rose 4 at a higher level than that of the hole 12 to facilitate circulation, that is on one side the drainage of the water and on the other the entrance of the air.

The hole 13 normally has a wider diameter than the spray holes 9, but can have virtually the same diameter and in this case it has the top 15 at a higher level than that of the spray holes 9.

Figure 3:
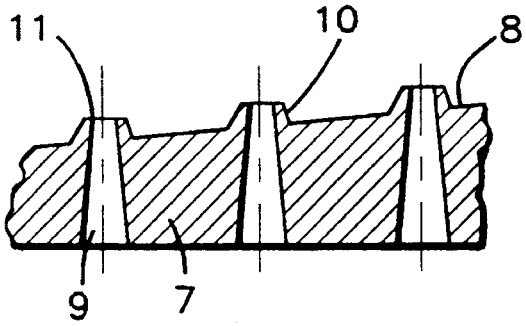
FIG. 3 is the enlarged view of a part of the nozzle in FIG. 2, which highlights the shape of the spray holes.

Preferably the latter do not have a diameter that is constant and, in particular have a truncated cone structure as exemplified in FIG. 3. With such a shape the fine layers of water that form at the top of the perforation holes 9 due to gravity tend to descend into these holes and thus become wider and finer as they gradually descend until they break and drip out of the lower surface of the nozzle carrying with them the salts dissolved therein.

With the solution exemplified in FIG. 4, the nozzle 18 is shown having a virtually constant thickness and the direction of the residual water inside the rose 4 towards the drainage hole 12 is achieved by positioning it at an angle on the metal ring 16 and by using suitable means to position the nozzle.

In the example shown, the means which assure the positioning of the nozzle 8 at an angle when attached to the rose 4 and therefore position the hole 12 at a lower level inside the rose 4, consist of a protruding tooth 17 near the drainage hole 12 and a corresponding recess in the crown of the metal ring 16 where the nozzle 18 is placed.

The nozzle that is the subject of the invention can be made of moulded plastic material, ceramic material or other materials as the nature of these materials, the shape of the nozzle's perimeter and the means of anchorage do not constitute the characterizing elements of the invention and are therefore variable.

I claim:

1. Shower nozzle comprising:

a shower head extending in the direction of a longitudinal axis from a fluid inlet to a fluid outlet; a disc-shaped plate having a surface facing said fluid inlet; means for securing the disc-shaped plate to the shower head; said surface extending in the direction of a horizontal axis which extends at an angle relative to said longitudinal axis from a first portion nearer said fluid inlet to a second portion near said fluid outlet; said disc-shaped plate having a first vent aperture extending therethrough at said first portion, and a second drainage aperture extending therethrough at said second portion; a plurality of spray perforations between said vent aperture and said drainage aperture; and said drainage aperture having a diameter greater than that of said spray perforations.

2. Shower nozzle according to claim 1, wherein the spray perforations have a varying diameter.

3. Shower nozzle according to claim 1, wherein the spray perforations have a truncated cone structure which diverges from the surface to the fluid outlet.

4. Shower nozzle according to claim 1, wherein the surface includes grooves intended to facilitate the flow of water towards the drainage aperture.

5. Shower nozzle according to claim 1, wherein the disc-shaped plate has a substantially constant thickness, and said shower nozzle further comprises means for positioning said disc-shaped plate so as to ensure that said disc-shaped plate is inclined when secured to the shower head.

* * * * *